US006703591B2

(12) United States Patent
Daum et al.

(10) Patent No.: US 6,703,591 B2
(45) Date of Patent: Mar. 9, 2004

(54) METHODS AND APPARATUS FOR SHABBOS/YOM TOV APPLIANCE CONTROL

(75) Inventors: Wolfgang Daum, Erie, PA (US); Kresimir Odorcic, Shepherdsville, KY (US); Tanveer Iqbal, Louisville, KY (US); John Steven Holmes, Sellersburg, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/754,599

(22) Filed: Jan. 5, 2001

(65) Prior Publication Data

US 2003/0066827 A1 Apr. 10, 2003

(51) Int. Cl.[7] ..... H05B 1/02

(52) U.S. Cl. ..... 219/492; 219/506; 219/494; 219/412; 200/43.01

(58) Field of Search ..... 219/506, 412, 219/492, 414, 508, 411, 494; 200/43.01; 307/117

(56) References Cited

U.S. PATENT DOCUMENTS 5,808,278 A * 9/1998 Moon et al.

* cited by examiner

*Primary Examiner*—Mark Paschall
(74) *Attorney, Agent, or Firm*—H. Neil Houser, Esq.; Armstrong Teasdale LLP

(57) ABSTRACT

An appliance control system is configured to operate an appliance in at least a normal mode and a holiday mode wherein normal mode operation of appliance feature elements is altered to better conform to religious customs, such as Orthodox Jewish customs. In response to user manipulation of a control interface panel, the control system is configured to enter the holiday mode upon user manipulation of the control interface panel with a designated key sequence. When in the holiday mode, response to user manipulation of the control interface panel is delayed for a randomly determined time, and appliance features of the normal mode that violate religious custom are disabled.

18 Claims, 5 Drawing Sheets

METHODS AND APPARATUS FOR SHABBOS/YOM TOV APPLIANCE CONTROL

BACKGROUND OF THE INVENTION

This invention relates generally to household appliance controls and, more particularly, to an apparatus and method for controlling appliances in accordance with religious customs.

Some religious customs, such as, for example, Orthodox Jewish customs, generally forbid doing work on the Sabbath and certain religious Holidays. The proscription of work extends even to the operation of household appliances, in which any action that causes the appliance to change state generally violates the custom. Thus, for example, user action that results in direct heating or cooling, beeping, illumination, and reading and writing by various components of an appliance are in violation of these religious customs.

Known electronic appliance controls, such as those for ovens and refrigerators, typically includes a variety of indicators, alarms, and functions that are incompatible with these religious customs.

BRIEF SUMMARY OF THE INVENTION

In an exemplary embodiment, an appliance control system is configured to operate an appliance in at least a normal mode and a holiday mode wherein normal mode operation of appliance feature elements is altered to better conform to religious customs, such as Orthodox Jewish customs. In response to user manipulation of a control interface panel, the control system is configured to enter the holiday mode upon user manipulation of the control interface panel with a designated key sequence. When in the holiday mode, response to user manipulation of the control interface panel is delayed for a randomly determined time, and appliance features of the normal mode that violate religious custom are disabled.

More specifically, implementation of new appliance element settings and display of associated indicators are delayed for respective randomly determined time periods of about 5 seconds to about 35 seconds. Appliance lamps, audio indicators, and other active functional elements that would violate religious custom are disabled in the holiday mode.

The holiday mode is entered when at least one input key is depressed in a designated sequence, thereby avoiding inadvertent activation of the holiday mode during, for example, cleaning of the appliance. The holiday mode is exited or terminated when the designated key sequence is again entered by the user. Thus, at any convenient time before the Sabbath or religious holiday begins, the appliance holiday mode may be easily entered by pressing a designated key sequence, and oven features are automatically adjusted to better conform to religious custom. After the Sabbath or holiday is over, holiday mode is easily exited and normal operation returned by again pressing a designated key sequence.

DETAILED DESCRIPTION OF THE INVENTION

Figure 1:
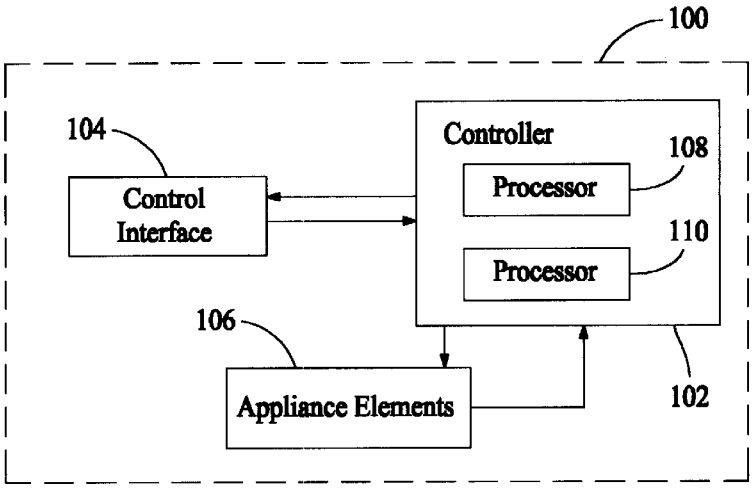
FIG. 1 is a block diagram of an exemplary appliance.

FIG. 1 illustrates a typical electronically controlled appliance 100 in block diagram form. Appliance 100 includes a controller 102 coupled to a control interface 104, and one or more appliance elements 106 operatively coupled to controller 102 for executing desired functions and features of appliance 100. Controller 102 includes a known processor 108 and a memory 110 for storing data and operational parameters for operating appliance elements 106. In response to user manipulation of control interface 104, controller 102 executes appliance routines and activates appliance features selected by the user. In one type of appliance 100, feedback control is used via known sensors or transducers (not shown) coupled to appliance elements 106 and controller 102. In response to feedback signals from the sensors and transducers, controller 102 makes control decisions and adjusts operation of appliance elements 106. Signals are sent from controller 102 to control interface 104 for displaying selected features and/or feedback to the user. It is believed that those in the field of electronic control systems could construct controller 102 to implement the following control scheme without further explanation of the electronics.

While the invention is described in the context of two exemplary appliances, namely, an oven and a refrigerator, each having a specific control interface, the benefits of the invention accrue generally to a wide variety of appliances with various control interfaces. The description set forth below is therefore for illustrative purposes only, and is neither intended to restrict practice of the invention to any particular type of appliance, including but not limited to ovens and refrigerators, nor intended to restrict practice of the invention to any particular control interface.

Figure 2:
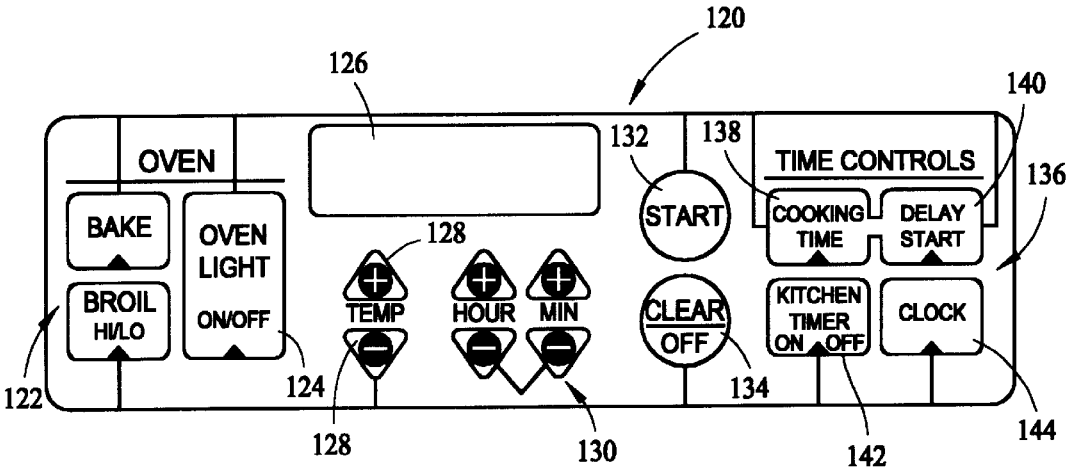
FIG. 2 illustrates a first exemplary control interface panel for the appliance shown in FIG. 1.

FIG. 2 illustrates an exemplary control panel 120 for use as control interface 104 of appliance 100 (shown in FIG. 1). More specifically, control panel 120 is configured for use with a known oven (not shown) controlled electronically using a known processor. Control panel 120 includes a plurality of touch-sensitive oven function input keys 122, an oven light on/off key 124, a display 126 for such information as time of day, oven temperature setting, and oven mode and timer settings. Control panel 120 also includes temperature setting keys 128, timer setting keys 130, a start key 132 for starting a particular function, a clear/off key 134 for canceling oven operations, and time control keys 136. Time control keys 136 include a cooking time key 138, a delay-start key 140, a kitchen timer key 142 and a clock key 144. Processor 108 (shown in FIG. 1) operates the various baking elements, heating elements, surface heating units, warmers, etc of known ovens and ranges, together with auxiliary components such as lights, timers, etc in response to user manipulation of control panel according to methods and techniques known in the art.

In one embodiment of an oven control system, a twelve-hour shut-off safety function is implemented so that the oven automatically turns off baking and heating elements after a predetermined period of operation, e.g., twelve hours of operation. Because activation of a oven during Sabbath would change the state of oven in violation of custom, the oven is typically turned on for the duration of the Sabbath so that the oven may be used yet without changing its state in a manner that would violate the Sabbath. If this safety feature is not disabled during the Sabbath or other religious holiday, custom will be violated when this safety shutdown feature executes.

The twelve hour shut-off safety function can therefore, in one embodiment, be disabled by user manipulation of control panel 120, such as, for example, by depressing two keys 122 at the same time, e.g. the baking key and the broiling key simultaneously for a predetermined time period, e.g., three seconds, until display 126 indicates that another user input is expected. The user then presses another key, e.g. delay-start key 140, to override, i.e., disable the twelve hour shut-off function and prevent its operation in violation of religious custom. By disabling the twelve hour shutoff function only when a plurality of keys 122 are manipulated in a designated sequence, inadvertent disabling of the safety feature, such as when cleaning control panel 120, is avoided. While the twelve-hour shut-off safety function is easily disabled for Sabbath and Holiday operation, other non-compliant oven features are not as easily changed in most systems.

Figure 3:
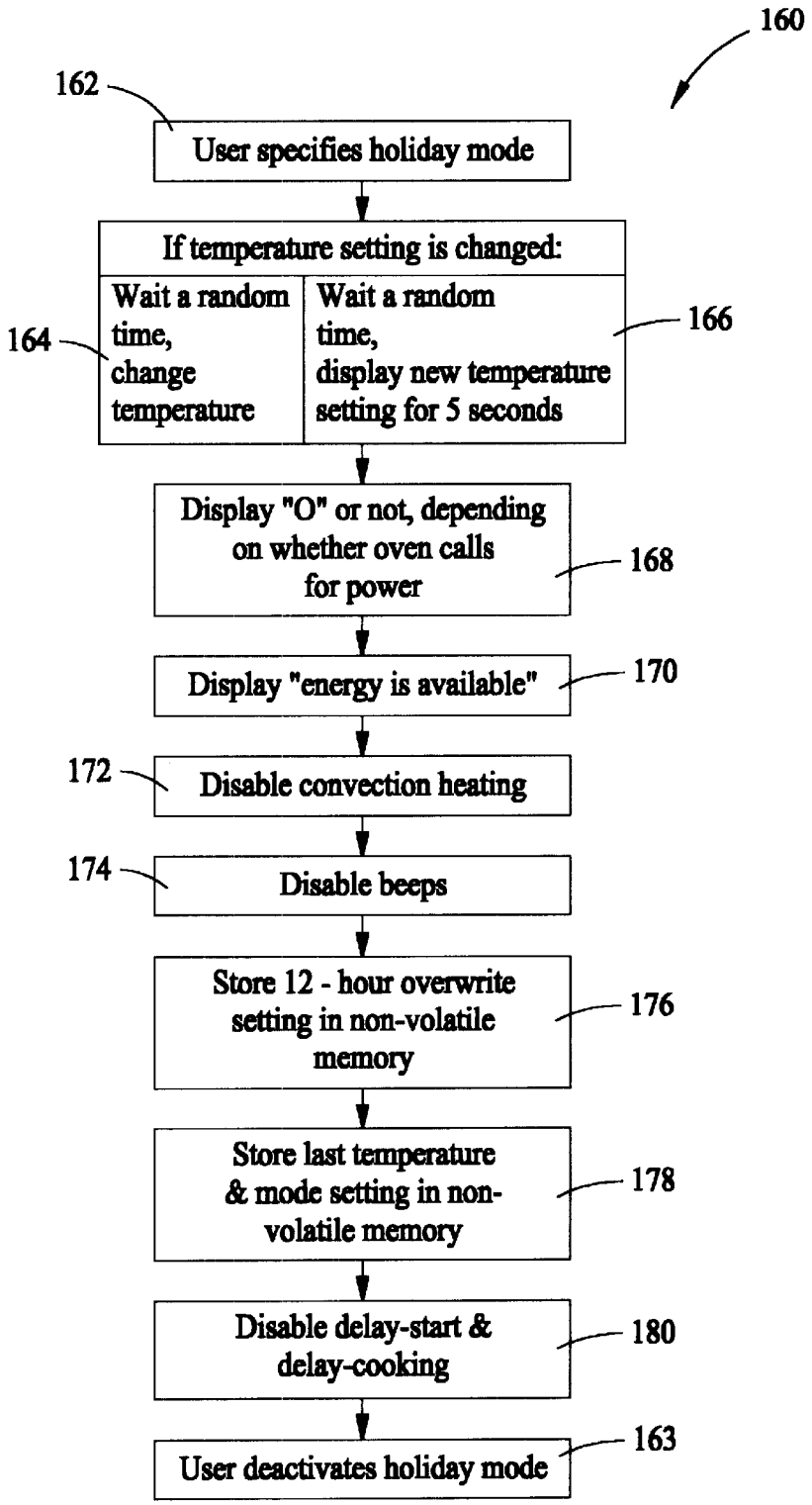
FIG. 3 is a flow diagram of a holiday mode for execution with the appliance shown in FIG. 1 via the control interface shown in FIG. 2.

FIG. 3 illustrates an algorithm 160 for controlling appliance 100, such as an oven associated with control panel 120 (shown in FIG. 2) in a holiday mode wherein appliance 100 is generally compliant with religious custom. Specifically, the holiday mode is implemented by adding, for example, a second twelve hour overwrite function. The second overwrite function, i.e. the holiday mode, is also entered by user manipulation of control panel 120, such as, for example, by depressing the same two keys as for the twelve-hour shut-off safety feature overwrite (e.g., the baking key and the broiling key) for a second predetermined time period, such as four seconds, followed by, in one embodiment, a four- to six-second press of the delay-start key. The holiday mode may also be exited or terminated 163 by depressing the same two keys for a predetermined time period and then depressing an additional key such as delay start key 140. Thus, by depressing three keys in a pre-designated sequence (two simultaneous depresses followed by a third) a three-state circulating system (normal operation, 12 hour overwrite, holiday mode, back to normal mode) is achieved.

In an alternative embodiment, the holiday mode is entered by manipulating a single key in a designated sequence, such as, for example, depressing the key for a predetermined time period or depressing the key more than once for the same or different predetermined time periods. In a further alternative embodiment, the holiday mode is exited by manipulating a single key in a designated sequence, whether the same or different key that is manipulated to enter the holiday mode. In still further alternative embodiments, combinations of the above-described single key and multiple key manipulations are employed to enter and exit the holiday mode.

Once the holiday mode is entered 162 with the selected key sequence, operational adjustments of appliance 100 are made to better comply with religious custom. For example, a randomly determined 25 to 35 second delay is entered 164 to act on new oven settings, and a random 25 to 35 second delay occurs 166 before the new setting is temporarily displayed for a brief period, such as five seconds. In one embodiment the random delay before acting on a new setting and the random delay before displaying the new setting are determined separately. In another embodiment, action on a new setting and displaying a new setting are delayed by equal amounts. In a further alternative embodiment, greater or lesser delay values than stated above are used.

A power on indicator, such as an "O" is displayed 168 when the oven calls for power, i.e., when the oven is turned on, and is not displayed when the oven does not call for power, i.e., when the oven is turned off. Therefore, the operational state of the oven may be visually determined. In one embodiment, another indicator is displayed 170 to indicate that energy is available to the oven, or, in other words, that the oven has not lost power.

In an embodiment in which the oven provides convection heating in normal mode, convection heating is disabled 172 when holiday mode is entered. Also, any beeps, alarms, or audio warnings used in normal operation are not utilized 174 in holiday mode. The twelve hour overwrite setting is stored 176 in non-volatile memory 108 of controller 102, and the last temperature and mode setting are also stored 178 in non-volatile memory 108 of controller 102. Thus, neither power outage nor brownout conditions change the mode. Any delay-start, delay-cooking modes, or other timed events available in normal operation that may violate religious custom are disabled 180 when holiday mode is entered 162.

Thus, at any convenient time before the Sabbath or religious holiday begins, the appliance holiday mode may be easily entered 162 by pressing a designated key sequence, and oven features are automatically adjusted to better conform to religious custom. After the Sabbath or holiday is over, holiday mode is easily exited 163 and normal operation returned by again pressing a designated key sequence.

Figure 4A:
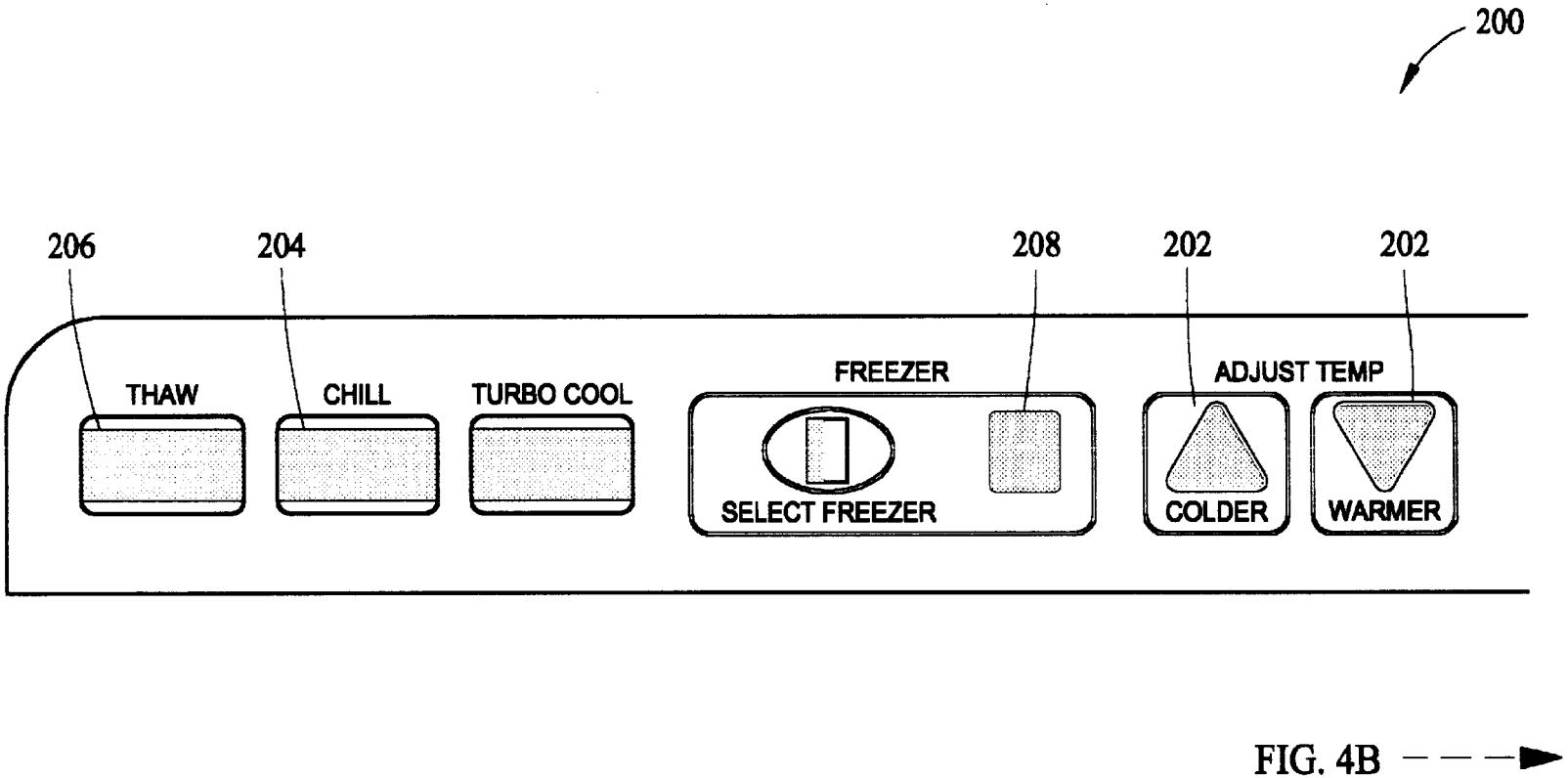
FIG. 4A illustrates a first portion of a secondary exemplary control interface panel for the appliance shown in FIG. 1.
Figure 4B:
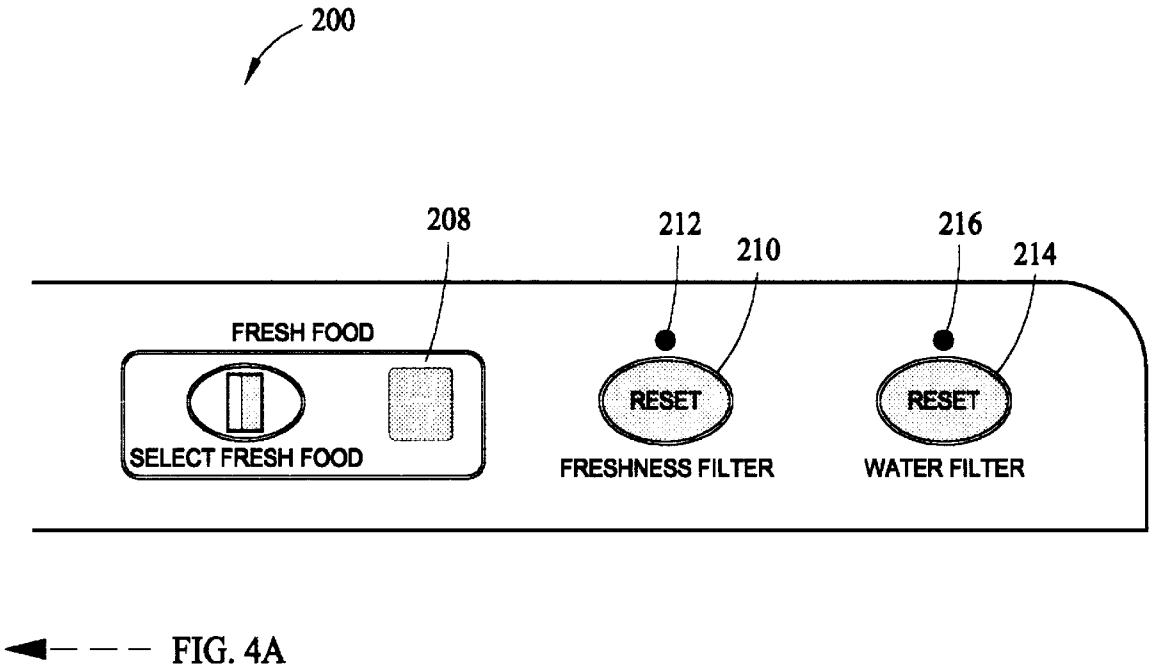
FIG. 4B illustrates a second portion of the secondary exemplary control interface panel for the appliance shown in FIG. 1.

FIGS. 4A and 4B illustrate another exemplary control panel 200 for use as control interface 104 of appliance 100 (shown in FIG. 1). More specifically, control panel 200 is configured for use with a known refrigerator (not shown) controlled electronically using a known processor. Control interface 200 includes input slew keys 202 for changing temperatures respectively in a refrigerator fresh food compartment and a freezer compartment. The interface also includes input keys 204, 206 for controlling quick chill and thaw functions, temperature setting displays 208, a freshness filter key 210 and indicator 212, and a water filter key 214 an indicator 216. In accordance with known methods and techniques, processor 108 operates various refrigeration components, including but limited to an evaporator, condenser, and various fans, together with auxiliary features such as lamps, in response to operator manipulation of control interface 200.

Using control interface 200, holiday a holiday mode is entered by pressing, for example, two designated interface keys for a predetermined time period, such as four seconds. The holiday mode is also exited by pressing the designated keys for a predetermined time. Therefore, a two-state circulating operation (normal, holiday mode, back to normal.) is achieved with relatively simple user input key sequences.

In an alternative embodiment, the holiday mode is entered by manipulating a single key in a designated sequence, such as, for example, depressing the key for a predetermined time period or depressing the key more than once for the same or different predetermined time periods. In a further alternative embodiment, the holiday mode is exited by manipulating a single key in a designated sequence, whether the same or different key that is manipulated to enter the holiday mode. In still further alternative embodiments, combinations of the above-described single key and multiple key manipulations are employed to enter and exit the holiday mode.

Figure 5:
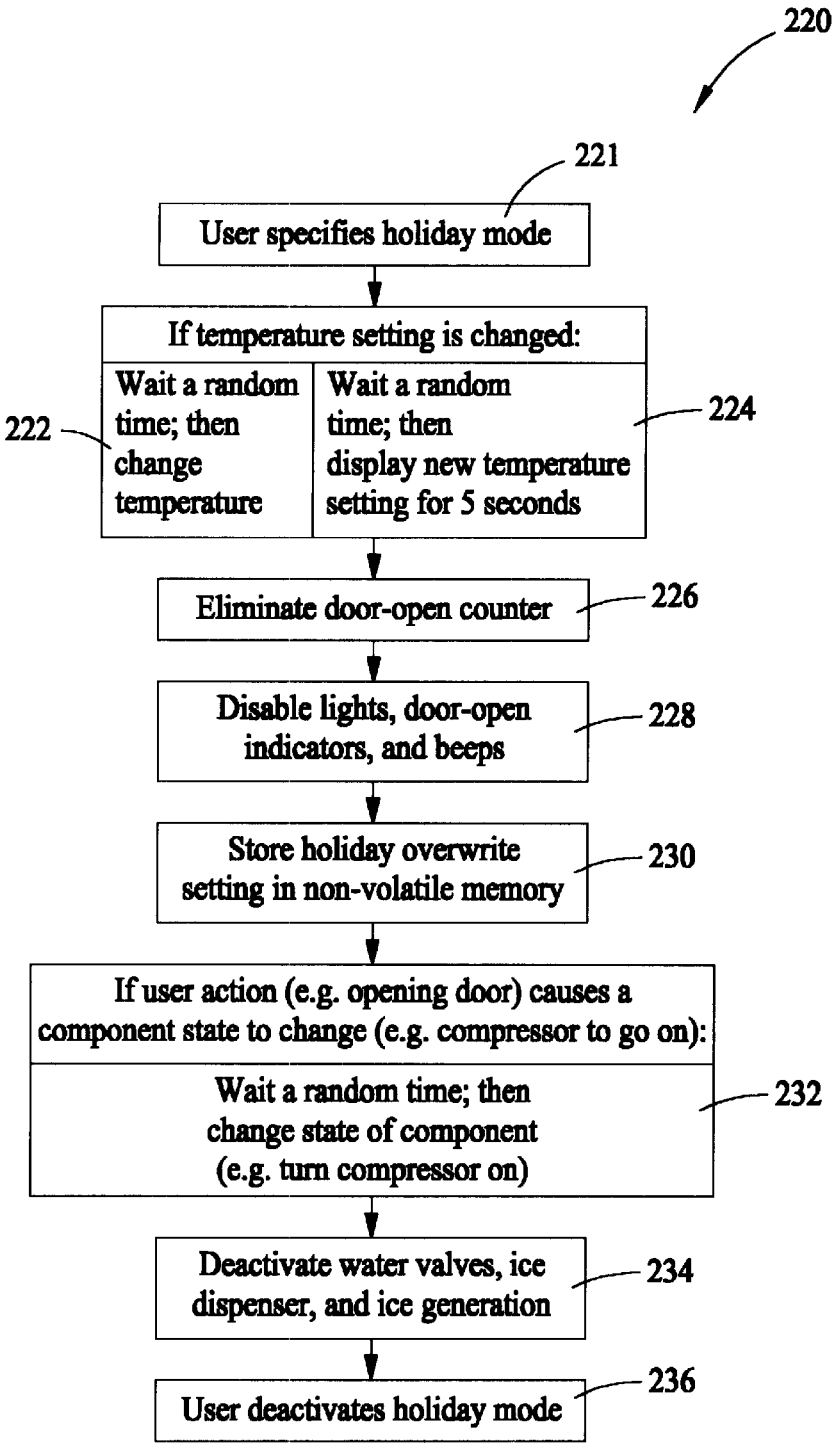
FIG. 5 is a flow diagram of holiday mode for execution with the appliance shown in FIG. 1 via the control interface shown in FIGS. 4A and 4B.

FIG. 5 illustrates a holiday mode control algorithm 220 for a refrigerator, such as one including control interface 200 (shown in FIG. 4). In holiday mode, operational adjustments are made to better comply with religious custom. For example, a randomly determined 25 to 35 second delay is entered 222 to act on new oven settings, and a random 25 to 35 second delay occurs 224 before the new setting is temporarily displayed for a brief period, such as five seconds. In one embodiment the random delay before acting on a new setting and the random delay before displaying the new setting are determined separately. In another embodiment, action on a new setting and displaying a new setting are delayed by equal amounts. In a further alternative embodiment, greater or lesser delay values than stated above are used.

In one embodiment in which the processor initiates an automatic defrost function based an amount of time that refrigerator doors have been opened, as determined by a door open detection element (e.g., a switch or sensor) and a counter, the door-open counter is not utilized 226 as it would violate certain religious customs. Any refrigerator lights that are switched on and off with opening of the refrigerator doors, or activated with other features are disabled 228. Any door-open indicators or alarms are disabled, and any beeps, alarms, or audio warnings pursuant to normal operation are not utilized 228 in holiday mode. The holiday mode or overwrite setting is stored 230 in a non-volatile memory of controller 102 so that neither power outage nor brownout conditions change the mode.

If, for example, a user opens a refrigerator compartment door and thereby causes an increase in the compartment temperature, a randomly determined 25 to 35 second delay is provided 232 before turning such components as a compressor and fans either on or off. In a refrigerator having an ice dispenser, water valves and the ice dispenser are deactivated 234. Ice generation also is deactivated 234.

Thus, at any convenient time before the Sabbath or religious holiday begins, the appliance holiday mode may be easily entered 221 by pressing a designated key sequence on control interface 200, and refrigerator operation and features are automatically adjusted to better conform to religious custom. After the Sabbath or holiday is over, holiday mode is easily exited 236 with a designated key sequence and normal operation returned by again pressing a designated key sequence.

While the invention has been described in terms of various specific embodiments, those skilled in the art will recognize that the invention can be practiced with modification within the spirit and scope of the claims.

What is claimed is:

1. A method for controlling an appliance, to appliance operable in at least a normal mode and a holiday mode, the appliance including an electronic control system and a control interface panel for user selection of appliance features, the control interface panel including a plurality of input keys and at least one display including a plurality of indicators for indicating appliance features and settings, said method comprising the step of:

delaying a display of at least one of the indicators for a first randomly determined time period.

2. A method in accordance with claim 1 wherein said step of delaying a display of at least one indicator comprises the step of delaying a display of a new temperature setting.

3. A method in accordance with claim 1 wherein said step of delaying a display of at least one of the indicators for a first randomly determined time period comprises the step of delaying a display of at least one of the indicators for a randomly determined time period of about 5 seconds to about 35 seconds.

4. A method in accordance with claim 1 further comprising actuating the control system to turn off an appliance feature after a predetermined time period of about twelve hours.

5. A method for controlling an appliance, the appliance operable in at least a normal mode and a holiday mode, the appliance including at least one lamp, at least one audio indicator, an electronic control system and a control interface panel for user selection of appliance features, the electronic control system including a twelve hour shut-off safety function, the control interface panel including a plurality of input keys, at least one display including a plurality of indicators for indicating appliance features and settings, said method comprising:

disabling the lamp when in the holiday mode;

disabling the audio indicator when in the holiday mode; and disabling the twelve hour shut-off safety function when in the holiday mode.

6. A method in accordance with claim 5 wherein disabling the twelve hour shut-off safety function when in the holiday mode comprises:

depressing at least two input keys simultaneously for a first predetermined period of time of about four seconds; and depressing a third key for a second predetermined period of time of about four seconds to six seconds after the at least two input keys are depressed.

7. A method in accordance with claim 1 wherein said step of entering the holiday mode upon user manipulation of the control interface panel comprises the step of entering the holiday mode when at least one input key is depressed.

8. A method in accordance with claim 7 wherein said step of entering the holiday mode when at least one input key is depressed comprises the step of entering the holiday mode when at least two input keys are depressed simultaneously.

9. A method in accordance with claim 8 wherein said step of entering the holiday mode further comprises the step of entering the holiday mode when a third input key is depressed after the at least two input keys are depressed.

10. A control system for an appliance operable in at least a normal mode and a holiday mode, the appliance including at least one appliance element and a control interface panel for user selection of appliance element operation and features, the control interface panel including a plurality of input keys and at least one display including a plurality of indicators for indicating appliance features and settings, said control system comprising:

a controller comprising a processor operatively coupled to the appliance elements and to the control interface panel, said controller configured to:

delay a display of at least one of the indicators for a randomly determined time period.

11. A control system in accordance with claim 10 further configured to delay a display of a new temperature setting.

12. A control system in accordance with claim 10 further configured to delay a display of at least one of the indicators for a second randomly determined time period that is equal to the first randomly determined time period.

13. A control system in accordance with claim 10 further configured to delay a display of at least one of the indicators far a randomly determined time period of about 5 seconds to about 35 seconds.

14. A control system in accordance with claim 10, the appliance further including at least one lamp, the controller further figured to disable the lamp when in the holiday mode.

15. A control system in accordance with claim 10, the normal mode including at least one audio indicator, said controller further configured to disable the audio indicator when in the holiday mode.

16. A control system for an appliance operable in at least a normal mode and a holiday mode, the appliance including at least one appliance element and a control interface panel for user selection of appliance element operation and features, the control interface panel including a plurality of input keys and at least one display including a plurality of indicators for indicating appliance features and settings, said control system comprising:

a controller comprising a processor operatively coupled to the appliance elements and to the control interface panel, said controller configured to:

enter the holiday mode when at least one input key is depressed, wherein the holiday mode includes a disabled lamp, a disabled audio indicator, and a disabled twelve hour shut off function.

17. A control system in accordance with claim 16 further configured to enter the holiday mode when at least two input keys are depressed simultaneously.

18. A control system in accordance with claim 16 further configured to enter the holiday mode when a third input key is depressed after the at least two input keys are depressed.

* * * * *

UNITED STATES PATENT AND TRADEMARK OFFICE

CERTIFICATE OF CORRECTION

PATENT NO. : 6,703,591 B2
DATED : March 9, 2004
INVENTOR(S) : Daum et al.

It is certified that error appears in the above-identified patent and that said Letters Patent is hereby corrected as shown below:

Column 6,
Line 56, after "one of the indicators for a" insert -- first --.

Signed and Sealed this

Twenty-ninth Day of November, 2005

JON W. DUDAS
*Director of the United States Patent and Trademark Office*